United States Patent [19]

Lahoda

[11] Patent Number: 4,540,512

[45] Date of Patent: Sep. 10, 1985

[54] RECOVERY OF BORIC ACID FROM NUCLEAR WASTE

[75] Inventor: Edward J. Lahoda, Pittsburgh, Pa.

[73] Assignee: Westinghouse Electric Corp., Pittsburgh, Pa.

[21] Appl. No.: 482,737

[22] Filed: Apr. 6, 1983

[51] Int. Cl.[3] ..... G21F 9/08; G21F 9/16

[52] U.S. Cl. ..... 252/629; 252/631; 252/628

[58] Field of Search ..... 252/628, 629, 631, 632; 376/328; 423/283

[56] References Cited

U.S. PATENT DOCUMENTS

| | | | |
|---|---|---|---|
| 4,073,683 | 2/1978 | Van Der Schoot | 376/328 |
| 4,086,325 | 4/1978 | Cordier et al. | 252/632 |
| 4,225,390 | 9/1980 | Brown et al. | 376/328 |
| 4,257,912 | 3/1981 | Fleischer et al. | 252/633 |
| 4,314,877 | 2/1982 | Queiser et al. | 252/632 |
| 4,377,507 | 3/1983 | Pope et al. | 252/629 |
| 4,379,081 | 4/1983 | Rootham et al. | 252/628 |
| 4,409,137 | 10/1983 | Mergan et al. | 252/632 |

FOREIGN PATENT DOCUMENTS 1600211 10/1981 United Kingdom .

OTHER PUBLICATIONS

*CRC Handbook of Chemistry and Physics*, 53rd Ed. (1972–1973) p. D-29.

*Primary Examiner*—Ben R. Padgett
*Assistant Examiner*—Virginia B. Caress
*Attorney, Agent, or Firm*—R. D. Fuerle

[57] ABSTRACT

Disclosed is a process for separating and recovering boric acid from water containing solids which include boric acid and radionuclides. In the first step, the water is separated from the solids by evaporation of the water at a temperature under 130° F. In the second step, an alcohol selected from the group consisting of methanol, ethanol, propanol, isopropanol, and mixtures thereof is added to the remaining solids in the amount of at least 1.4 times that stoichiometrically required to react with the boric acid to form boron alkoxide and water to about 100 mole % in excess of stoichiometric. In the third step, the boron alkoxide is separated from the remaining solids by evaporation of the boron alkoxide. In the fourth step, water is added to the volatilized boron alkoxide to form boric acid and an alcohol. And finally, the alcohol is separated from the boric acid by evaporating the alcohol.

7 Claims, 2 Drawing Figures

RECOVERY OF BORIC ACID FROM NUCLEAR WASTE

BACKGROUND OF THE INVENTION

Nuclear wastes containing large amounts of boric acid are generated during the operation of pressurized water reactor (PWR) electrical generating plants. Other sources of such wastes are low level burial sites which have either intercepted and stored run-off from the burial trenches or received unacceptable, unsolidified boric acid waste.

The most popular method for solidifying low level waste in power plants is to concentrate the waste to 12% boric acid in waste evaporators, then mix the waste with concrete. Alternatively, a bitumen or a water expandable polymer may be mixed with the waste to produce a solid mass. While methods for reducing the volume of the waste have been devised, the volume of the waste is still large, and the high concentrations of boric acid in the waste may interfere with the setting of concrete. Also, boric acid is a very leachable substance in concrete and as it leaches out, it leaves pores through which the radionuclides can escape.

SUMMARY OF THE INVENTION

We have discovered a process for separating and recovering boric acid from water containing nuclear wastes and boric acid.

The process of this invention lowers the volume and mass of nuclear waste that must be solidified up to about eight times less than it would be if the boric acid were present. The resulting cement containing the nuclear waste without boric acid present is stronger and less susceptible to leaching of the radionuclides. An added advantage of the process of this invention is that the boric acid is recovered and can be reused in the nuclear reactor. The process of this invention is relatively uncomplicated and inexpensive to implement.

RELEVANT ART

The 53rd Edition of the CRC Handbook of Chemistry and Physics, page D-29, shows that an azeotrope is formed of 27.0% methanol and 73.0% trimethylborate which boils at 54.0° C.

U.S. Pat. No. 4,086,325 discloses a process for drying solutions containing boric acid by the addition of an oxidizing agent, such as hydrogen peroxide. The boric acid solution is first neutralized with sodium hydroxide. The sodium borate is then oxidized to an insoluble perborate by the addition of hydrogen peroxide.

U.S. Pat. Nos. 4,225,390 and 4,073,683 both disclose boron control systems for a nuclear power plant which include an evaporative boric acid recovery apparatus.

U.S. Pat. No. 4,314,877 discloses a method and apparatus for drawing radioactive waste for the concentrates from evaporators in order to reduce the volume on the resultant waste.

U.S. Pat. No. 4,257,912 discloses a process for encapsulating spent nuclear fuel into concrete.

DESCRIPTION OF THE INVENTION

FIG. 1 is described in detail in Example 1.

FIG. 2 is described in detail in Example 2.

Figure 1:
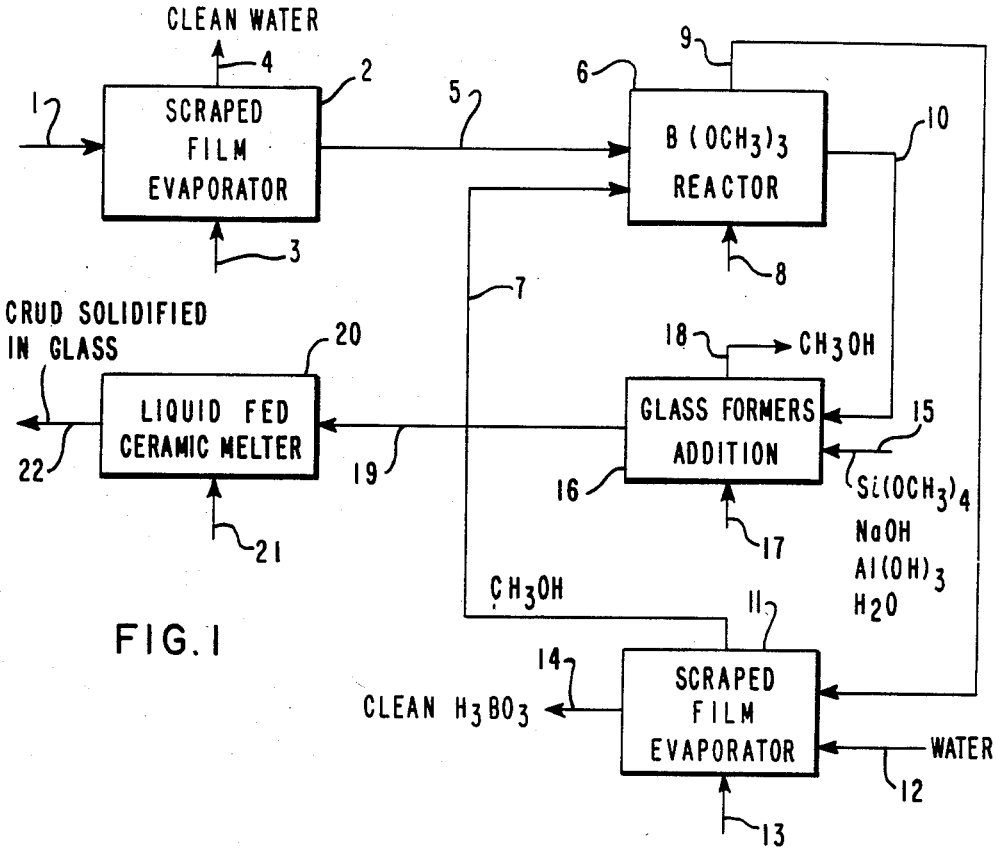
FIG. 1 is a block diagram which illustrates a certain presently preferred embodiment of a process according to this invention.

The radioactive stream containing boric acid which is treated in the process of this invention is an aqueous stream which typically comes from the primary loop of pressurized water reactors. That stream may consist of about 10 to 1,000 ppm of boron, usually as boric acid, and may also contain lithium, calcium, magnesium, aluminum, suspended solids such as metal oxides, and radionuclides such as cobalt and various fission products. The stream is usually heated to evaporate some of the water and concentrate the boric acid to about 4 to about 12%. (All percentages herein are by weight unless otherwise indicated.)

In the first step of the process of this invention, the aqueous stream containing the boric acid and radionuclides is evaporated to dryness. This can be accomplished in a spray dryer or other type of evaporator, but it is preferably done in a scraped film evaporator because that is one of the few types of evaporators that will take the stream to complete dryness. The drying should be done at temperatures less than 130° F. to avoid volatilizing the boric acid. Preferably, the evaporation should be done under vacuum at temperatures less than 100° F., which can be easily accomplished in a scraped film evaporator.

In the second step of this invention, the solids from the first step are mixed with an alcohol to form a boron alkoxide. The alcohol reacts with the boric acid to form the corresponding boron alkoxide and water according to the equation:

$$3ROH + H_3BO_3 \rightarrow B(OR)_3 + 3H_2O,$$

where R is alkyl. The alcohol, in addition to reacting with the boric acid to form a boron alkoxide, also forms an azeotrope with the boron alkoxide. Sufficient alcohol should be added to react with all of the boric acid which is present and form the azeotrope. That is, the amount of alcohol should be at least 1.4 times the stoichiometric reaction amount, and up to about 100 mole % in excess of stoichiometric may be used to ensure complete reaction. The alcohol may be methanol, ethanol, propanol, isopropanol, or a mixture thereof, but methanol is preferred as boron methoxide is the most stable boron alkoxide and it forms the lowest boiling point azeotrope, which reduces its chances of decomposition. If ethanol, propanol, or isopropanol is used, it may be necessary to add benzene or another compound which forms an azeotrope with water in order to remove the water as it is formed.

In the next step of this invention, the stream is heated to evaporate the boron alkoxide and the alcohol. If methanol is used, they will evaporate together as a boron alkoxide-alcohol azeotrope. If ethanol, propanol, or isopropanol is used, an alcohol-water azeotrope will evaporate first, followed by the boron alkoxide. The methanol azeotrope is 27% methanol and 73% trimethylborate and the temperature of a stream will be 54° C., the temperature at which the azeotrope evaporates. Evaporation is preferably performed by using steam around the jacket of the reactor. Steam at about 212° to 338° F. in an amount of about 2½ to 3 pounds of steam per pound of boric acid is suitable if 1.4 times the stoichiometric amount of methanol is used.

The material remaining in the bottom of the reactor ("crud") may then be solidified in cement, glass, or other materials, according to processes well known in the art. A relatively new way of solidifying this material is to add alkoxide glass formers which are then partially hydrolyzed and heated to form a polymeric glass. (See U.S. Pat. Nos. 4,376,070; 4,377,507; 4,422,965; and 4,430,257), herein incorporated by reference.

In the fourth step of the process of this invention, the vaporized boron alkoxide is mixed with water to reform boric acid according to the equation:

$$B(OR)_3+3H_2O \rightarrow 3ROH+H_3BO_3.$$

The amount of water used should be at least stoichiometric, but excess water will not be a disadvantage as the boric acid is mixed with water for reuse in the reactor anyway. Recycled boric acid is typically about a 4% solution.

In the fifth step of the process of this invention, the alcohol is separated from the boric acid by evaporation of the alcohol to leave a relatively pure boric acid aqueous solution. This is accomplished by heating the stream at the boiling point of alcohol, which is 64.7° C. for methanol, until all of the alcohol has been removed. Again, a scrapped film evaporator is the preferred apparatus, though other evaporators can also be used. The remaining boric acid can then be recycled into the reactor, if desired. The process of this invention can be conducted continuously, in batch, or a mixture of continuous and batch; batch is preferred as it is easier to control.

The following examples more fully illustrate the process of this invention.

EXAMPLE 1

FIG. 1 is a block diagram which shows the process of this invention using methanol to form boron methoxide, and using alkoxide glass formers to solidify the solids.

In FIG. 1, an aqueous solution containing 12% boric acid and 1% crud passes through line 1 to scraped film evaporator 2, which is heated with steam in line 3 producing clean water in line 4. The solids pass through line 5 to boric acid reactor 6. Methanol enters the reactor in line 7 and steam in line 8 heats the reactor. The azeotrope leaves the reactor in line 9 and the crud leaves in line 10. The azeotrope passes to scraped film evaporator 11 and is mixed with water in line 12. Heat from steam in line 13 evaporates methanol in line 7, leaving clean boric acid in line 14. Meanwhile, the crud in line 10 is mixed with alkoxide glass formers in line 15 in mixer 16. Steam heat from line 17 evaporates the methanol in line 18. The solids then move through line 19 to melter 20, where electrical power is applied (line 21), producing crud solidified in glass in line 22. The following table gives the flow rate, temperature, and material balance in the various lines shown in FIG. 1.

| | Stream Number | | | | | | | | | | | | |
|---|---|---|---|---|---|---|---|---|---|---|---|---|---|
| | 1 | 4 | 5 | 3 | 9 | 10 | 8 | 18 | 17 | 15 | 7 | 19 | 22 |
| Flow Rate (lb/hr) | 500 | 427.8 | 72.2 | 427.8 | 147.6 | 64.6 | 174 | 80.1 | 79 | 32.2 | 140 | 16.7 | 16.7 |
| Temperature (°F.) | 70 | 120 | 120 | 338 | 158 | 158 | 338 | 212 | 338 | 70 | 70 | 212 | 2022 |
| Component (w/o) | | | | | | | | | | | | | |
| $H_2O$ | 87.0 | 100 | 10.0 | 100 | 0 | 92.2 | 100 | 75.7 | 100 | 1.21 | 0 | 0 | 0 |
| $H_3BO_3$ | 12.0 | 0 | 83.1 | 0 | 0 | 0 | 0 | 0 | 0 | 0 | 0 | 17.5 | 17.5 |
| Crud | 1.0 | 0 | 6.9 | 0 | 0 | 7.78 | 0 | 0 | 0 | 0 | 0 | 30.0 | 30.0 |
| $CH_3OH$ | 0 | 0 | 0 | 0 | 31.7 | 0 | 0 | 24.3 | 0 | 54.5 | 100 | 0 | 0 |
| $SiO_2$ | 0 | 0 | 0 | 0 | 0 | 0 | 0 | 0 | 0 | 25.6[2] | 0 | 49.3 | 49.3 |
| $Na_2O$ | 0 | 0 | 0 | 0 | 0 | 0 | 0 | 0 | 0 | 3.39[3] | 0 | 6.53 | 6.53 |
| $Al_2O_3$ | 0 | 0 | 0 | 0 | 0 | 0 | 0 | 0 | 0 | 3.51[4] | 0 | 4.43 | 4.43 |
| $B(OCH_3)_3$ | 0 | 0 | 0 | 0 | 68.3 | 0 | 0 | 0 | 0 | 11.7 | 0 | 0 | 0 |

Stream 21 — Electrical Power — 20 kw
Stream 14 — 4 w/o $H_3BO_3$ in $H_2O$ — 1500 lb/hr
Stream 13 — Steam — 140 lb/hr
Stream 12 — $H_2O$ — 1492.4 lb/hr
Final Volume Reduction — 105
Final Weight Reduction — 30
[1]As $Al(OH_3)$
[2]As $Si(OCH_3)_4$
[3]As NaOH
[4]As $B_2O_3$

EXAMPLE 3

Figure 2:
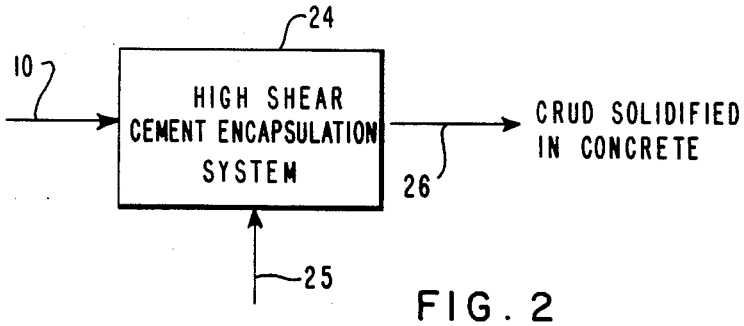
FIG. 2 is a block diagram which illustrates an alternative step in the process shown in FIG. 1.

FIG. 2 illustrates a modification of the process shown in FIG. 1 where the solids are encapsulated in cement instead of in glass forming alkoxides.

In FIG. 2, crud in line 10 passes instead to cement encapsulation system 24 where water and cement from line 25 are added. The product, crud solidified in cement, leaves by line 26. The following table gives the flow rate, temperature, and material balance for the lines shown in FIG. 2.

| Stream Number | 10* | 25 | 25 |
|---|---|---|---|
| Flow Rate (lb/hr) | 19 | 31.6 | 50.6 |
| Temperature (°F.) | 158 | 70 | 70 |
| $H_2O$ (%) | 92.22 | 0 | 27.6 |
| Crud (Bottoms) (%) | 26.3 | 0 | 9.9 |
| $B(OCH_3)_3$ (%) | 0 | 0 | 0 |
| Cement (%) | 0 | 100 | 62.5 |

*Process #2 removes all $H_2O$ until the only product is $B_2O_3$
Final Weight Reduction 10.1
Final Volume Reduction 26.6

I claim:

1. A process for separating and recovering boric acid from water containing solids which include boric acid and radionuclides comprising:

(A) separating said water from said solids by evaporating said water at a temperature under about 130° F.;

(B) adding methanol to said solids in at least the amount stoichiometrically required to (1) react with said boric acid to form boron methoxide and water, and (2) form a boron methoxide-methanol azeotrope;

(C) separating said boron methoxide by evaporating said boron methoxide-methanol azeotrope by heating it at its boiling point, 54° C.;

(D) adding water to said boron methoxide to form boric acid and methanol; and (E) separating said methanol from said boric acid by evaporating said methanol.

2. A process according to claim 1 wherein said water is evaporated in a scrapped film evaporator.

3. A process according to claim 1 wherein said water is evaporated under a vacuum at a temperature of less than about 100° F.

4. A process according to claim 1 wherein each step is conducted as a batch process.

5. A process according to claim 1 wherein said alcohol is evaporated in a scrapped film evaporator.

6. A process according to claim 1 including the additional step after step (C) of incorporating said solids in glass using glass-forming alkoxides.

7. A process according to claim 1 including the additional step after step (C) of incorporating said solids in cement.

* * * * *